US005447087A

United States Patent [19]

Hawes et al.

[11] Patent Number: 5,447,087

[45] Date of Patent: Sep. 5, 1995

[54] DRUM HEAD TENSIONING MECHANISM

[75] Inventors: Paul A. Hawes, Leicester; David Orton, Hinckley, both of England

[73] Assignee: Premier Percussion Limited, England

[21] Appl. No.: 209,157

[22] Filed: Mar. 10, 1994

[30] Foreign Application Priority Data

Mar. 10, 1993 [GB] United Kingdom ..... 9119662

[51] Int. Cl.[6] ..... G10D 13/02

[52] U.S. Cl. ..... 84/413

[58] Field of Search ..... 84/411 R, 413, 421

[56] References Cited

U.S. PATENT DOCUMENTS 1,090,426 3/1974 Thomas ..... 84/411 R
4,570,526 2/1986 Hoshino ..... 84/413
4,869,146 9/1989 Bonsor ..... 84/413

FOREIGN PATENT DOCUMENTS 498115 1/1939 United Kingdom .
2201026 8/1988 United Kingdom .

*Primary Examiner*—Michael L. Gellner
*Assistant Examiner*—Patrick J. Stanzione
*Attorney, Agent, or Firm*—Basile and Hanlon

[57] ABSTRACT

In drum head tensioning mechanism of or for a musical drum, an intermediate hoop assembly or cage is secured about the drum shell by end abutment therewith and supports top and bottom drum heads. Top and bottom counterhoops are provided about the drum heads and respectively engage flesh hoops on the drum heads. Upper and lower tensioning bolt assemblies connect the counterhoops to the intermediate hoop assembly, the lower bolt assemblies extending upwardly towards and interspaced with the upper bolt assemblies whereby all the bolt assemblies are accessible for conveniently and independently adjusting both top and bottom drum head tension. The interior of the drum shell also remains "clean" for optimum sound quality.

10 Claims, 2 Drawing Sheets

FIG 2
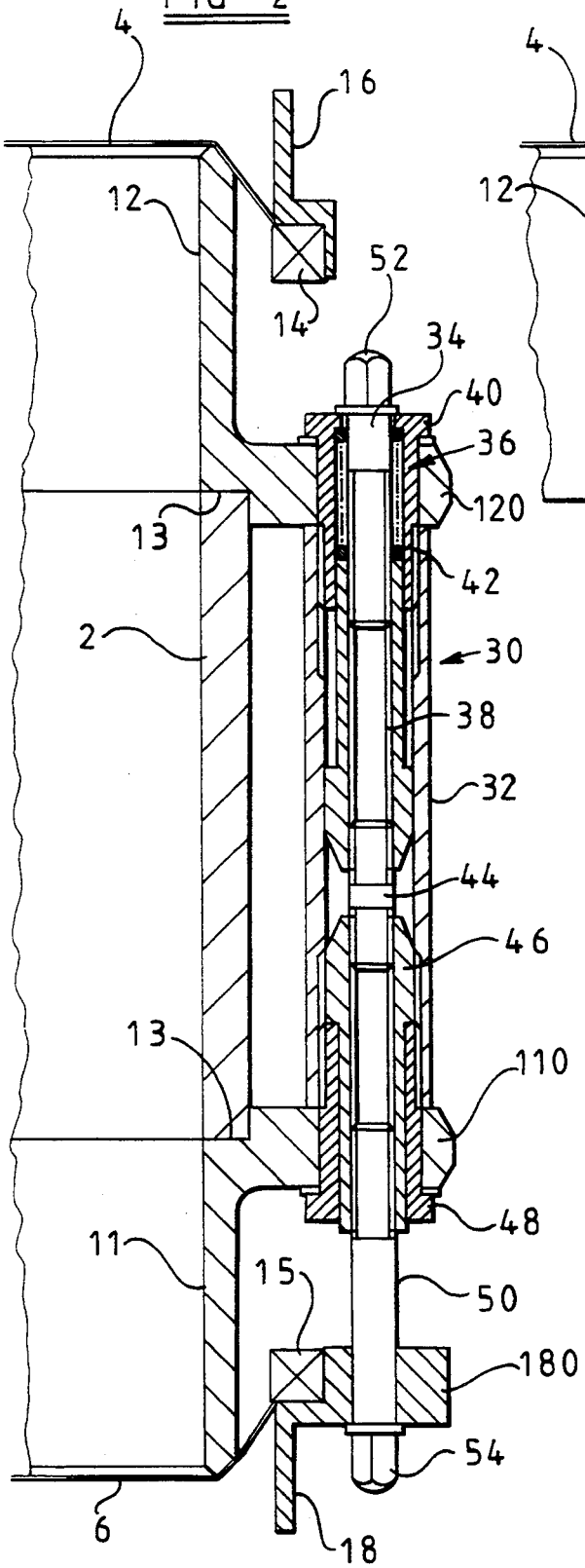
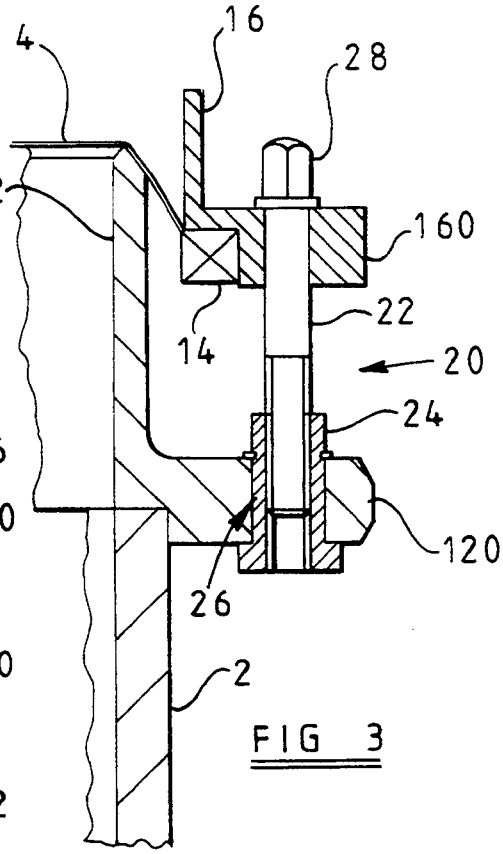
FIG 3

DRUM HEAD TENSIONING MECHANISM

BACKGROUND OF THE INVENTION

This invention relates to drum head tensioning mechanisms of or for a musical drum.

A musical drum consists of a cylindrical drum shell over the open ends of which respective drum heads are tensioned. Each drum head consists of a circular "skin" having a diameter slightly greater than the diameter of the drumshell, a flesh hoop being secured to the periphery of the skin. The skin rests against an annular bearing edge of the drum shell with the flesh hoop lying alongside the outer surface of the drum shell.

In order to tension the skin, pressure is applied to the flesh hoop in a direction away from the bearing edge. Pressure may be applied to the drum shell in a variety of ways. Many of the ways involve the provision of fittings such as brackets secured to the drum shell and against which a skin tensioning device may bear or be secured. A disadvantage of this type of arrangement is that the inner cylindrical surface of the drum shell is disturbed, for example, by securing bolts for the brackets, thus removing the drum shell's clean inner surface and so causing a deterioration in the sound quality produced.

A further problem associated with this type of construction is that the mechanical strength of the drum shell is weakened and the shell tends to become damaged under excess tension or even the tensions normally applied to military and pipe band drums, which are of the order of 80 to 100 psi.

In other types of drums, the drum shell is located within a cage, the skin tensioning devices being secured to the cage rather than the drum shell. This type of construction enables the drum shell's inner surface to remain clean and at the same time enables at least some of the mechanical stress resulting from. tensioning of the drum heads to be carried by the cage rather than the drum shell per se.

In a known construction of this type, a counterhoop is placed over each drum head and a plurality of peripherally spaced bolts connected between the top and bottom counterhoops. A particularly advantageous form of this construction is described in United Kingdom patent application No. 2,201,026,in which a plurality of bolt adjusting assemblies for the top and bottom counterhoops are provided. The bolt assemblies for the top counterhoop are angularly offset with respect to the bolt assemblies for the bottom counterhoop.

While a musical drum is being played, the tension of the skin may vary and it is therefore necessary to be able to adjust the tensioning of the skin. It is of course particularly desirable that this adjustment should be capable of being carried out as quickly and conveniently as practicable, with the least possible interruption to the performance.

The known drums of counterhoop construction, as described above, have the disadvantage that access is required to both the top and bottom faces of the drum in order to be able to adjust the tensioning of the top and bottom skins respectively.

In a known construction of musical drum as described in U.S. Pat. No. 1,090,426, a tensioning adjustment system is described in which the tension of both the top and bottom skins can be adjusted from the same face of the drum. However this system is suitable only for drums of the type in which the fittings by which pressure is applied to the skin are secured to the drum shell itself. The system described therefore suffers from the disadvantage of deterioration in sound quality and mechanical weakening as discussed above and therefore does not meet current commercial requirements.

In addition, it is a further disadvantage of the drum described in U.S. Pat. No. 1,090,426, that when a skin has to be replaced, the fixing bolts have to be retensioned and the drum has to be retuned.

SUMMARY OF THE INVENTION

It is an object of the present invention to provide tensioning mechanism of or for a musical drum in which the above disadvantages are reduced or substantially obviated and a freely resonating chamber is retained in the drum shell.

The invention provides a drum head tensioning mechanism of or for a musical drum in which the mechanism comprises an intermediate hoop assembly secured about the drum shell by end abutting engagement therewith and supporting one or both of the drum heads in relation to the shell; top and bottom counterhoops respectively about the top and bottom drum heads and engaging their flesh hoops; angularly spaced apart tensioning bolt means connecting the top counterhoop to the intermediate hoop assembly for adjusting tension of the top drum head, and angularly spaced apart further tensioning bolt means connected between the bottom counterhoop and the intermediate hoop assembly for adjusting the tension of the bottom drum head, the further tensioning bolt means extending upwardly towards and interspaced with the aforesaid tensioning bolt means of the top counterhoop whereby all the tensioning bolt means are accessible adjacent the top counter hoop for conveniently and independently adjusting the tension of both the top and bottom drum heads.

BRIEF DESCRIPTION OF THE DRAWINGS

FIG. 2 is a cross section view along the line II—II of FIG. 1; and

FIG. 3 is a cross section view along the line III—III of FIG. 1.

DESCRIPTION OF A PREFERRED EMBODIMENT

Figure 1:
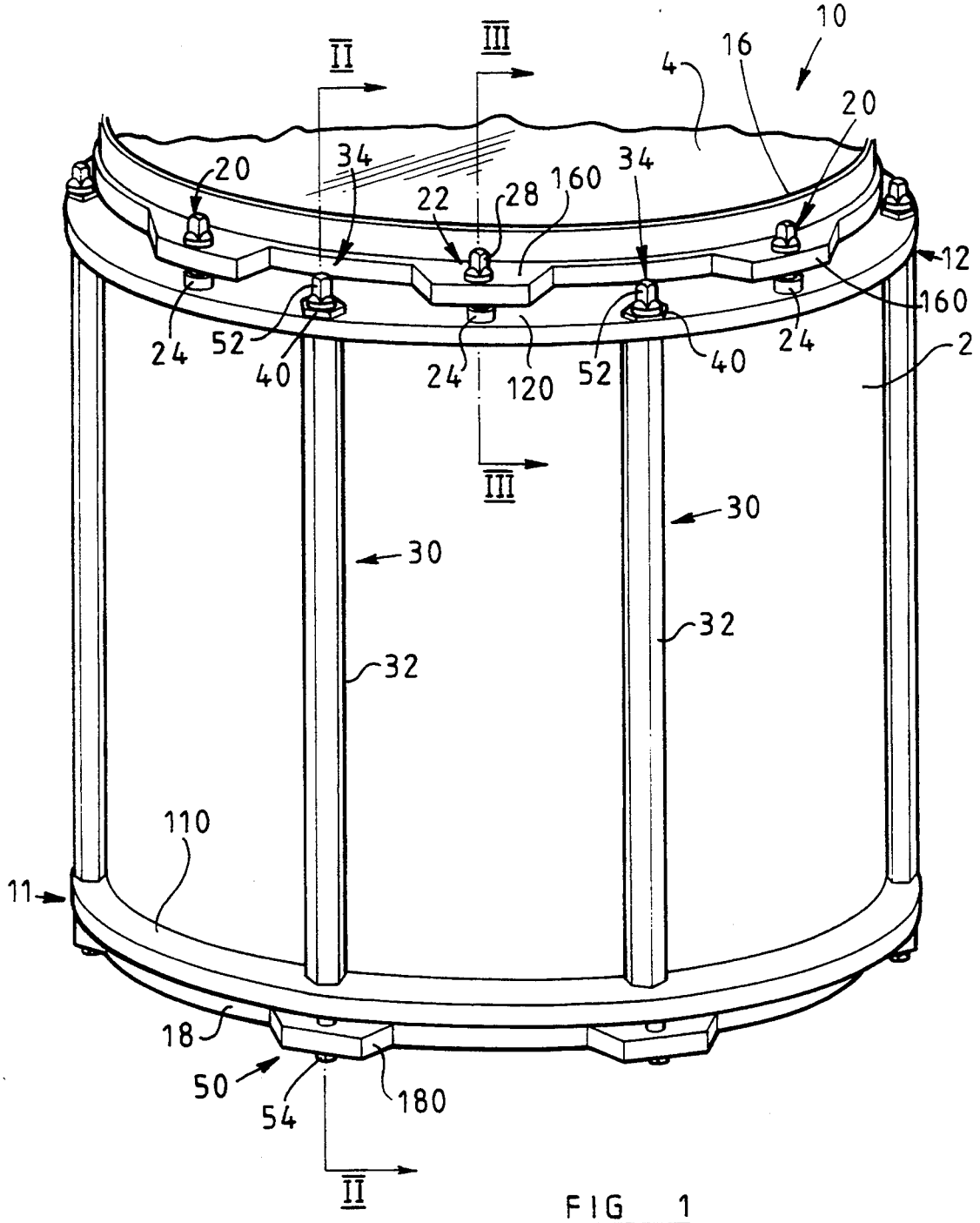
FIG. 1 is a perspective view of a musical drum provided with the tensioning mechanism of the present invention.

Referring first to FIGS. 1 and 2, a drum assembly 10 comprises a cylindrical drum shell 2 to the open ends of which respective top and bottom drum heads 4, 6 are applied, the bottom head 6 and the top head 4 being stretched over intermediate hoops 11, 12 located in end abutment by flanges 13 onto the ends of the drum shell 2. Both drum heads 4, 6 contain flesh hoops 14, 15 secured to a peripheral edge of each head. Top and bottom counterhoops 16, 18 are placed about each drum head 4, 6 and are caused to engage the respective flesh hoops 14, 15.

The upper head 4 is tensioned by a plurality of angularly spaced apart tensioning bolt assemblies 20 which are best seen in FIG. 3 and which extend between the intermediate hoop 12 and the top counterhoop 16. Each assembly 20 consists of a bolt 22 which passes through a radial lug 160 of the top counterhoop 16 and is threaded in an internally threaded bushing 24 received in an aperture 26 therefore in a lower radial flange 120 of the intermediate hoop 12. The head 28 of each bolt 22 is key adjustable by a standard drum key, the location of the head 28 being readily accessible to a drummer.

The lower or bottom drum head 6 is also independently tensioned by a plurality of tensioning bolt assemblies 30 angularly spaced about the drum and interspaced in relation to the bolt assemblies 20.

Each tensioning bolt assembly 30 for the bottom drum head 6 extends from a flange 120 of the intermediate hoop 12 to the bottom counterhoop 18 through a tubular pillar 32, the pillars 32 connecting the top and bottom intermediate hoops 12, 11 and providing a cage about the drum shell 2.

A tensioning bolt 34 of the assembly 30 passes through the bore 36 of a hollow bolt 40 threaded in the upper end of the pillar 32 for securing it to the flange 120. The bolt 34 engages a lug nut 38 biased downwardly in the pillar 32 by a compression spring 42 acting from within the hollow bolt 40 on the lug nut 38. The lug nut 38 is connected via a tie rod 44 to a second lower lug nut 46 located in a second pillar securing nut 48 in the flange 110 of the bottom intermediate hoop 11. The threaded tie rod connection 44 of the lug nuts 38, 46 provides for their relative axial adjustment during assembly. The second lug nut 46 is, in turn, connected via a connecting bolt 50 to a radial lug 180 of the bottom counterhoop 18.

The lug nuts 38, 46 are constrained for axial sliding movement only in the pillar 32 and are of hexagonal configuration for this purpose within the pillar 32 having a corresponding hexagonal cross section.

The head 52 of the tensioning bolt 34 is also adjustable by a standard drum key and the location of the head 52 is again readily accessible to a drummer, so that, through the interconnected lug nuts 38, 46 and the connecting bolt 50, tensioning of the bottom drum head 6 can be adjusted.

The arrangement of the bolt assembly 50 permits a worn or damaged lower head 6 to be easily replaced, the new head being "rough" or coarse tensioned using a key on the bolt head 54, fine tuning being achieved by the top bolt 34. "Rough" tuning is achieved by the bolt 50 passing a fixed distance, e.g. its threaded length, into the lug nut 46.

In a modification, the ends of the pillar 32 may be respectively screw threaded in the bores through the flanges 120, 110, hollow bolts 40, 48 of suitable length being also threaded in the flange bores so as to abut the respective ends of the pillar 32 with a lock nut action. The exterior of the pillar 32 is of hexagonal or similar form to received a spanner for this purpose.

What is claimed is:

1. A drum head tensioning mechanism for a musical drum in which the drum includes a drum shell having top and bottom drum heads attached thereto each having a peripheral flesh hoop, said drum head tensioning mechanism comprising:

an intermediate hoop assembly secured about the drum shell by end abutting engagement therewith and supporting at least one of the top and bottom drum heads in relation to the drum shell;

a top counterhoop disposed about the top drum head and engaging the flesh hoop thereof;

angularly spaced apart tensioning bolt means connecting the top counterhoop to the intermediate hoop assembly for adjusting the tension of the top drum head;

a bottom counterhoop disposed about the bottom drum head and engaging the flesh hoop thereof; and an angularly spaced apart further tensioning bolt means connected between the bottom counterhoop and the intermediate hoop assembly for adjusting the tension of the bottom drum head, said further tensioning bolt means extending upwardly towards and interspaced with the tensioning bolt means of the top counterhoop whereby all the tensioning bolt means and the further tensioning bolt means are accessible adjacent the top counterhoop for conveniently and independently adjusting the tension of both the top and bottom drum heads.

2. The drum head tensioning mechanism according to claim 1 wherein the further tensioning bolt means is supported by the intermediate hoop assembly.

3. The drum head tensioning mechanism according to claim 1 wherein the intermediate hoop assembly comprises a pair of connected top and bottom intermediate hoop members each in respective end abutting engagement with the drum shell and each supporting a corresponding top and bottom drum head.

4. The drum head tensioning mechanism according to claim 3 wherein the top and bottom intermediate hoop members are connected together by angularly spaced apart pillars to substantially provide a cage about the drum shell.

5. The drum head tensioning mechanism according to claim 4 wherein the pillars are tubular and angularly spaced apart, the further tensioning bolt means each passing upwardly through a respective pillar towards the tensioning bolt means of the top counterhoop.

6. The drum head tensioning mechanism according to claim 1 wherein the further tensioning bolt means is connected at its lower end by an axially adjustable connection member to the bottom counterhoop for separate tension adjustment of the bottom drum head or to permit removal of the bottom drum head.

7. The drum head tensioning mechanism according to claim 6 wherein the axially adjustable connection member comprises a bolt extending upwardly from the bottom counterhoop and having a screw threaded engagement with the further tensioning bolt means.

8. The drum head tensioning mechanism according to claim 5 wherein each further tensioning bolt means comprises an upper operating bolt having a screw threaded engagement with nut means constrained for axial movement only within the respective tubular pillar, said nut means having a screw threaded engagement at its lower end with an axially adjustable connection member connecting the lower end of the further tensioning bolt means to the bottom counterhoop for separate axial adjustment of the connection member and of the bottom counterhoop connected thereto.

9. The drum head tensioning mechanism according to claim 8 wherein the nut means is spring loaded in a downward direction within the tubular pillar.

10. The drum head tensioning mechanism according to claim 8 wherein the nut means comprises a pair of nut members each constrained for axial movement only within the tubular pillar and interconnected for relative axial adjustment.

* * * * *